United States Patent [19]

Bartoes et al.

[11] Patent Number: 4,976,419

[45] Date of Patent: Dec. 11, 1990

[54] BUCKLE CHUTE FOLDER EXIT ROLLERS

[75] Inventors: Robert J. Bartoes, Lagrangeville, N.Y.; Eugene A. Wirth, Huntington, Conn.

[73] Assignee: Pitney Bowes Inc., Stamford, Conn.

[21] Appl. No.: 315,622

[22] Filed: Feb. 23, 1989

[51] Int. Cl.[5] ..... B42C 1/00

[52] U.S. Cl. ..... 270/45; 270/32; 493/420

[58] Field of Search ..... 493/405, 419, 420, 454, 493/421; 270/32, 45, 46, 37, 47, 48, 49, 50

[56] References Cited

U.S. PATENT DOCUMENTS

| | | | |
|---|---|---|---|
| 2,253,446 | 8/1941 | Spiess | 493/420 |
| 3,416,785 | 12/1968 | Sherman | 270/45 |
| 4,288,067 | 9/1981 | Viganó493 | 420/ |
| 4,475,896 | 10/1984 | Bains | 493/454 |

*Primary Examiner*—Edward K. Look
*Assistant Examiner*—Therese M. Newholm
*Attorney, Agent, or Firm*—Charles R. Malandra, Jr.; Melvin J. Scolnick; David E. Pitchenik

[57] ABSTRACT

A buckle chute folder for folding a plurality of paper sheets. The folder includes: a buckle chute; a pair of folding rollers downstream of the buckle chute; a curved paper guide downstream and adjacent the folding rollers for changing the direction of the folded sheets as they exit the folding rollers; and a pair of exit rollers downstream of the paper guide. One of the exit rollers has a fluorinated ethylene propylene sleeve whereby neither of the exit rollers feeds a paper sheet forming a part of the plurality of paper sheets ahead of any other of the paper sheets forming the plurality of paper sheets.

4 Claims, 2 Drawing Sheets

BUCKLE CHUTE FOLDER EXIT ROLLERS

BACKGROUND OF THE INVENTION

The instant invention relates to buckle chute folders used for folding one or more sheets of paper, and more particularly to the exit rollers used with such buckle chute folders.

Buckle chute paper folders employing folding rollers are well known. The sheet of paper is fed by a first pair of feed rollers up into a buckle chute, which stops the forward progress of the paper sheet and causes a buckle to be formed. The buckle is then forced to enter the nip of a pair of folding rollers which impart a crease in the buckle. The folding rollers then continue to feed the folded sheet of paper toward a pair of exit rollers, whose nip is invariably not in the path of the paper being fed from the folding rollers. In order to change the direction of the path of travel of the folded paper, a curved guide or chute is employed to direct the folded paper toward the nip of the exit rollers. With today's demand for high throughput in folding machines, it is becoming common practice to fold a plurality of paper sheets simultaneously.

Typically, the exit rollers discussed hereinabove are formed from a rubber, generally a urethane, and as the plurality of folded papers leave the pair of folding rollers the bottom sheets tends to drag on the chute and the fold tends to open up; the top layer of the outermost sheet begins to pucker up because it is constrained in a shorter distance than the bottom layer between the folding rollers and the exit rollers. As the plurality of folded sheets approaches the exit rollers, the top or outermost sheet is contacted by the upper exit roller which feeds it ahead of the other folded sheets, resulting in the top or outermost sheet receiving a second crease on its lead edge which then causes problems when the plurality of folded paper sheets are inserted into an envelope located downstream.

Thus, the instant invention provides a unique construction for the exit rollers which obviates the problem discussed hereinabove and permits a group of folded paper sheets to enter the exit rollers of the buckle chute folder without a second crease being formed on any of the folded paper sheets.

SUMMARY OF THE INVENTION

Accordingly, the instant invention provides a buckle chute folder for folding a plurality of paper sheets, comprising: a buckle chute; a pair of folding rollers downstream of the buckle chute; a curved paper guide downstream and adjacent the folding rollers for changing the direction of the folded sheets as they exit the folding rollers; and a pair of exit rollers downstream of the paper guide. One of the exit rollers has a fluorinated ethylene propylene sleeve whereby neither of the exit rollers feeds a paper sheet forming a part of the plurality of paper sheets ahead of any other of the paper sheets forming the plurality of paper sheets.

DETAILED DESCRIPTION

Figure 1:
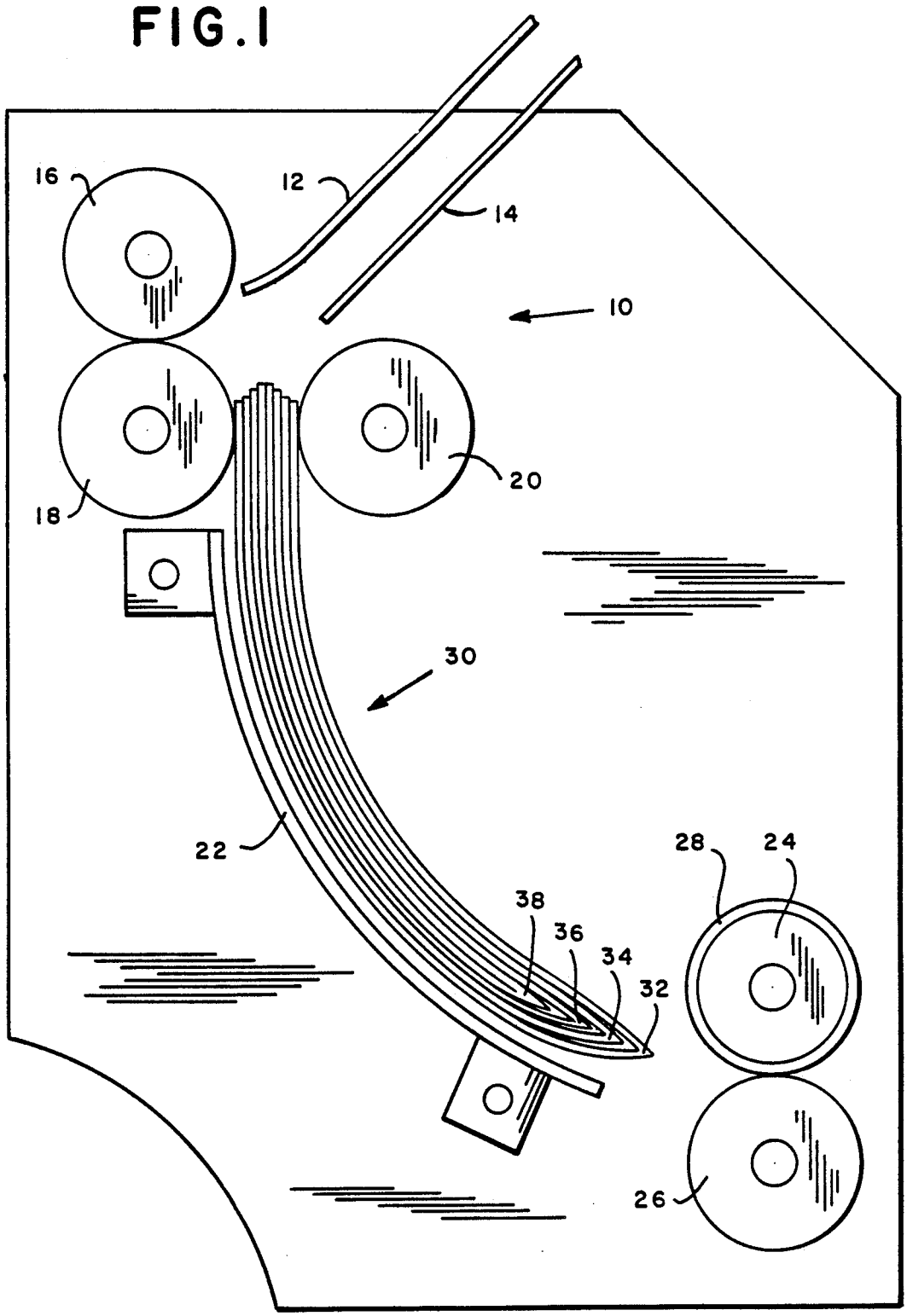
FIG. 1 is a schematic, side elevation view of a buckle chute folder and exit rollers in accordance with the instant invention, showing a group of folded sheets of paper approaching the exit rollers.
Figure 2:
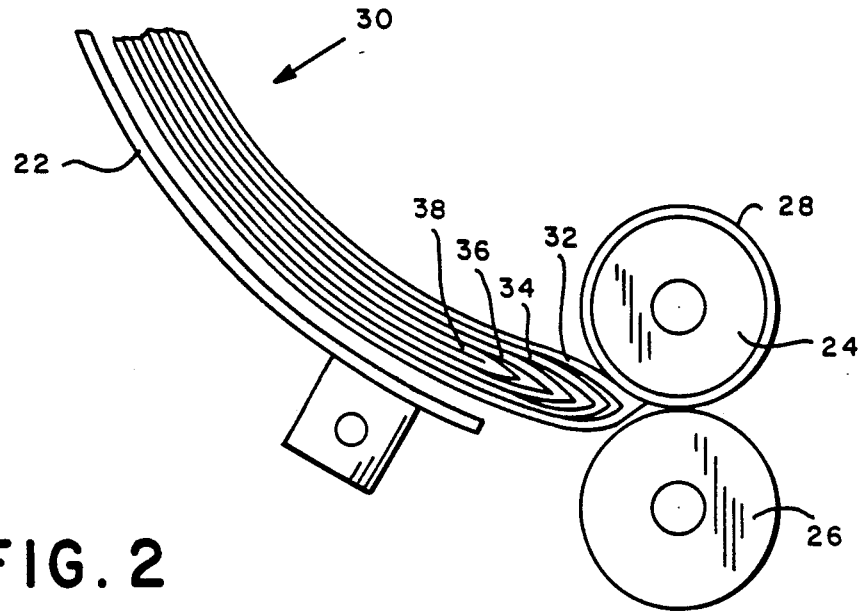
FIG. 2 is a schematic, side elevation view of the exit rollers showing the group of folded sheets just prior to entering the nip of the exit rollers.
Figure 3:
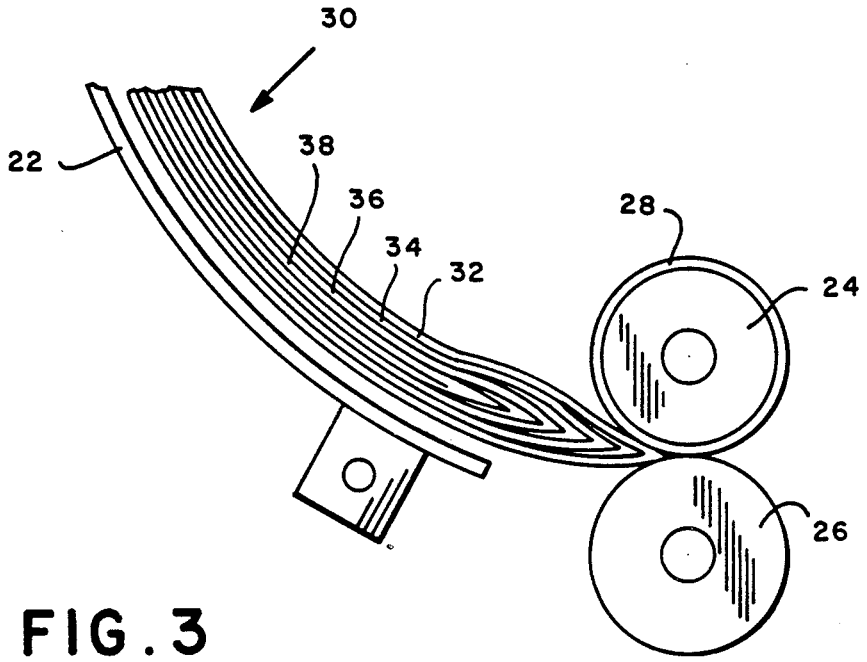
FIG. 3 is similar to FIG. 2 but shows the group of folded sheets of paper in the nip of the exit rollers.

In describing the preferred embodiment of the instant invention, reference is made to the drawings, wherein there is seen in FIG. 1 a buckle chute folder generally designated 10 consisting of a pair of buckle chute plates 12 and 14, a pair of feeding rollers 16 and 18 and a third roller 20 which cooperates with the feeding roller 18 to form a pair of folding rollers. The functioning of the buckle chute folder 10 is well known and thus will not be further described. Situated below the rollers 18 and 20 is a curved guide chute 22 which leads to a pair of exit rollers 24 and 26. The chute 22 serves to direct the paper flow from the rollers 18 and 20 toward the rollers 24 and 26, which are on fixed centers.

The bottom exit roller 26 typically is formed from a rubber, urethane being a preferred rubber, and Mearthane TM being a preferred urethane. The top exit roller 24 is also formed from a urethane rubber, but it includes a shrunk-on teflon (fluorinated ethylene propylene) sleeve 28, which causes the surface of the roller 24 to be smooth. Situated on the chute 22 is a group 30 of four folded sheets of paper 32, 34, 36 and 38. The smoothness of the teflon sleeve 28 causes the surface of the roller 24 to be smooth and thus not drive the top sheet 32 ahead of the other sheets 34, 36 and 38 thereby eliminating the double crease that is otherwise formed on the top sheet 32. The teflon sleeve 28 possesses a unique combination of properties owing to its low co-efficient of friction, excellent anti-stick property and flexibility, which permits the upper surfaces of the sheets of paper being processed to slip until the lower surfaces enter the bite of the exit rollers 24 and 26 and prevent the rollers 24 and 26 from prematurely feeding the top surfaces of the sheets of paper being processed.

Although the preferred embodiment has been described in terms of the exit rollers 26 and 28 being situated beneath the folding rollers 18 and 20, the teflon sleeve may be used on either one of a pair of exit rollers depending upon the orientation of the paper sheets as they enter the nip of the exit rollers.

It should be understood by those skilled in the art that various modifications may be made in the present invention without departing from the spirit and scope thereof, as described in the specification and defined in the appended claims.

What is claimed is:

1. A buckle chute folder for folding a plurality of paper sheets, comprising:

a buckle chute;

a pair of folding rollers downstream of said buckle chute;

a curved paper guide downstream and adjacent said folding rollers for changing the direction of the folded sheets as they exit said folding rollers; and a pair of exit rollers downstream of said paper guide, one of said exit rollers having a fluorinated ethylene propylene sleeve whereby neither of said exit rollers feeds a paper sheet forming a part of said plurality of paper sheets ahead of any other of the paper sheets forming said plurality of paper sheets.

2. The buckle chute folder of claim 1, wherein said exit rollers are located below said folding rollers.

3. The buckle chute folder of claim 2, wherein one of said exit rollers is located above the other of said exit rollers.

4. The buckle chute folder of claim 3, wherein said one exit roller includes said fluorinated ethylene propylene sleeve.

* * * * *